US008317067B2

(12) United States Patent
Lewis

(10) Patent No.: US 8,317,067 B2
(45) Date of Patent: Nov. 27, 2012

(54) DEVICE HOLDER WITH MAGNETIC RETAINER

(76) Inventor: Charles A. Lewis, Folsom, CA (US)

( * ) Notice: Subject to any disclaimer, the term of this patent is extended or adjusted under 35 U.S.C. 154(b) by 547 days.

(21) Appl. No.: 12/588,212

(22) Filed: Oct. 7, 2009

(65) Prior Publication Data

US 2011/0079619 A1 Apr. 7, 2011

(51) Int. Cl.
*A45F 5/00* (2006.01)

(52) U.S. Cl. ..... 224/183; 224/930; 224/271

(58) Field of Classification Search ..... 224/183, 224/930, 929, 584, 191, 663, 668, 669, 678, 224/679, 271, 272; 206/320, 305, 350, 818
See application file for complete search history.

(56) References Cited

U.S. PATENT DOCUMENTS

| | | | | |
|---|---|---|---|---|
| 2,176,052 | A | 10/1939 | Beyer | |
| 4,135,653 | A | 1/1979 | Sieloff | |
| 4,489,867 | A | 12/1984 | Schwemberger | |
| 4,500,019 | A | 2/1985 | Curley, Jr. | |
| 5,369,899 | A * | 12/1994 | Reeves | 40/1.5 |
| 5,410,762 | A * | 5/1995 | Maskovich | 2/338 |
| 5,897,040 | A * | 4/1999 | Ward | 224/413 |
| 6,176,401 | B1 * | 1/2001 | Lim | 224/196 |
| 6,382,482 | B1 * | 5/2002 | Chao | 224/312 |
| 6,502,727 | B1 * | 1/2003 | Decoteau | 224/162 |
| 6,945,503 | B2 | 9/2005 | Cohen | |
| 6,955,484 | B2 | 10/2005 | Woodman | |
| 7,076,885 | B2 * | 7/2006 | Potter | 33/768 |
| D530,079 | S * | 10/2006 | Thomas et al. | D14/203.3 |
| 7,243,824 | B2 | 7/2007 | Tabata | |
| 7,255,228 | B2 * | 8/2007 | Kim | 206/320 |
| 7,312,984 | B2 * | 12/2007 | Richardson et al. | 361/679.41 |
| 2002/0100782 | A1 * | 8/2002 | Marvin | 224/483 |
| 2003/0222109 | A1 | 12/2003 | Weiss | |
| 2005/0167485 | A1 * | 8/2005 | Taras | 235/380 |
| 2006/0016841 | A1 | 1/2006 | Shurm | |
| 2006/0266776 | A1 | 11/2006 | Plakke | |
| 2007/0019387 | A1 * | 1/2007 | Schipper et al. | 361/725 |

(Continued)

FOREIGN PATENT DOCUMENTS

GB 2209928 A 6/1989

OTHER PUBLICATIONS

Stick your iPod here, four pages from the Internet May 18, 2009, http://travel.latimes.com/daily-deal-blog/index.php/stick-your-ipod-here-3799/.

*Primary Examiner* — Nathan J Newhouse
*Assistant Examiner* — Matthew Theis
(74) *Attorney, Agent, or Firm* — Richard C. Litman

(57) ABSTRACT

The device holder with magnetic retainer is a holder that removably attaches to a garment by magnetic attraction. The holder typically holds a portable electronic device and includes a frame having a recess that receives the portable electronic device therein. The back portion of the frame retains a first magnetic member. A second magnetic member is designed to be positioned underneath a garment, such as a back of a shirt sleeve, so that a portion of the garment is positioned between the first and second magnetic members to attach the device to the garment. Front and rear peripheral edges of the device holder form a cord receiving channel that excess cord of the electronic device can be wrapped around, thereby facilitating neat storage of the excess cord.

12 Claims, 8 Drawing Sheets

U.S. PATENT DOCUMENTS

2007/0099681 A1* 5/2007 Kielland ..... 455/575.1
2007/0165371 A1* 7/2007 Brandenburg ..... 361/683
2007/0215663 A1* 9/2007 Chongson et al. ..... 224/930
2007/0262112 A1* 11/2007 Butler et al. ..... 224/669
2008/0011794 A1 1/2008 Daniel
2008/0023508 A1 1/2008 Harchol
2008/0110951 A1* 5/2008 Lauri ..... 224/584
2008/0223889 A1 9/2008 Rossell et al.
2009/0050657 A1 2/2009 Woolery

* cited by examiner

DEVICE HOLDER WITH MAGNETIC RETAINER

BACKGROUND OF THE INVENTION

1. Field of the Invention

The present invention relates generally to a holders for cell phones, music players, and other electronic devices, and particularly to a device holder with magnetic retainer that and be used to attach the electronic device holder to a shirt sleeve or other garment.

2. Description of the Related Art

It is typical to see exercise enthusiasts, such as bicyclists, joggers and runners, carrying portable radios, tape players and the like to enjoy music or other information along with their exercise. These devices are usually carried in pouches strapped to the user or in the pockets of the outer garments of the user.

Whenever a user wants to change a tape or change a station, he or she must access the equipment in the pouch or pocket and then make the change. This can be a bit troublesome and detracts from the pleasure of the exercise. The headset or headphone wires are also troublesome, since they can get in the way of normal movement of the head and arms and can become dislodged from the ears during movement of the head and arms.

Thus, a device holder with magnetic retainer solving the aforementioned problems is desired.

SUMMARY OF THE INVENTION

The device holder with magnetic retainer is a holder that is removably attachable to a garment by magnetic attraction. The holder typically holds a portable electronic device and includes a frame having a recess that receives the portable electronic device therein. The back portion of the frame retains a first magnetic member. A second magnetic member is designed to be positioned underneath a garment, such as a back of a shirt sleeve, so that a portion of the garment is positioned between the first and second magnetic members to attach the device to the garment.

Front and rear peripheral edges of the device holder form a cord-receiving channel around which any excess cord of the electronic device can be wrapped, thereby facilitating neat wrapping of, e.g., a headset cord from the device in order to store any excess length of cord.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
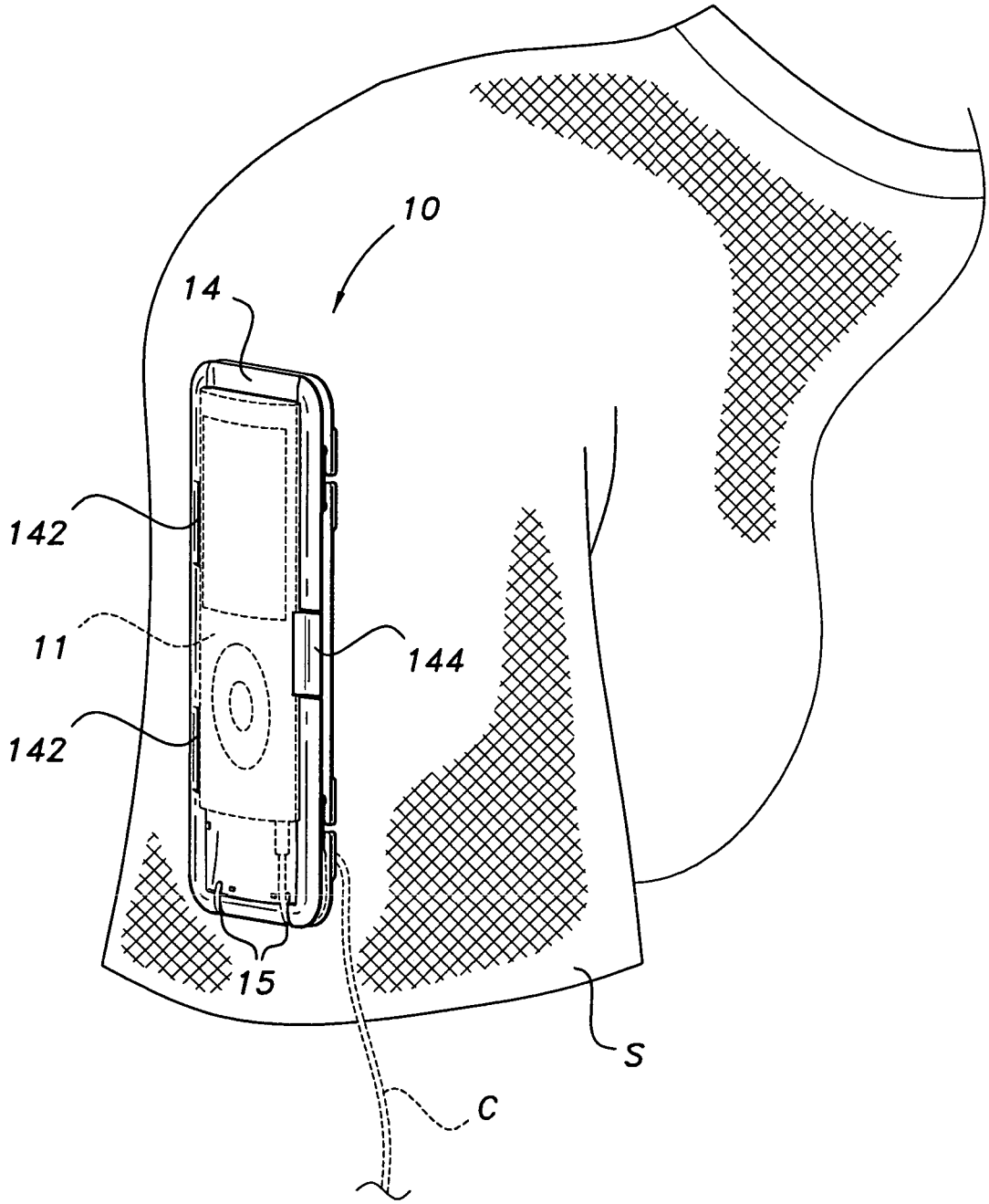
FIG. 1A is an environmental, perspective view of a device holder with magnetic retainer according to the present invention, showing an electronic device having a straight plug and consequent routing of the headset cord.
Figure 2:
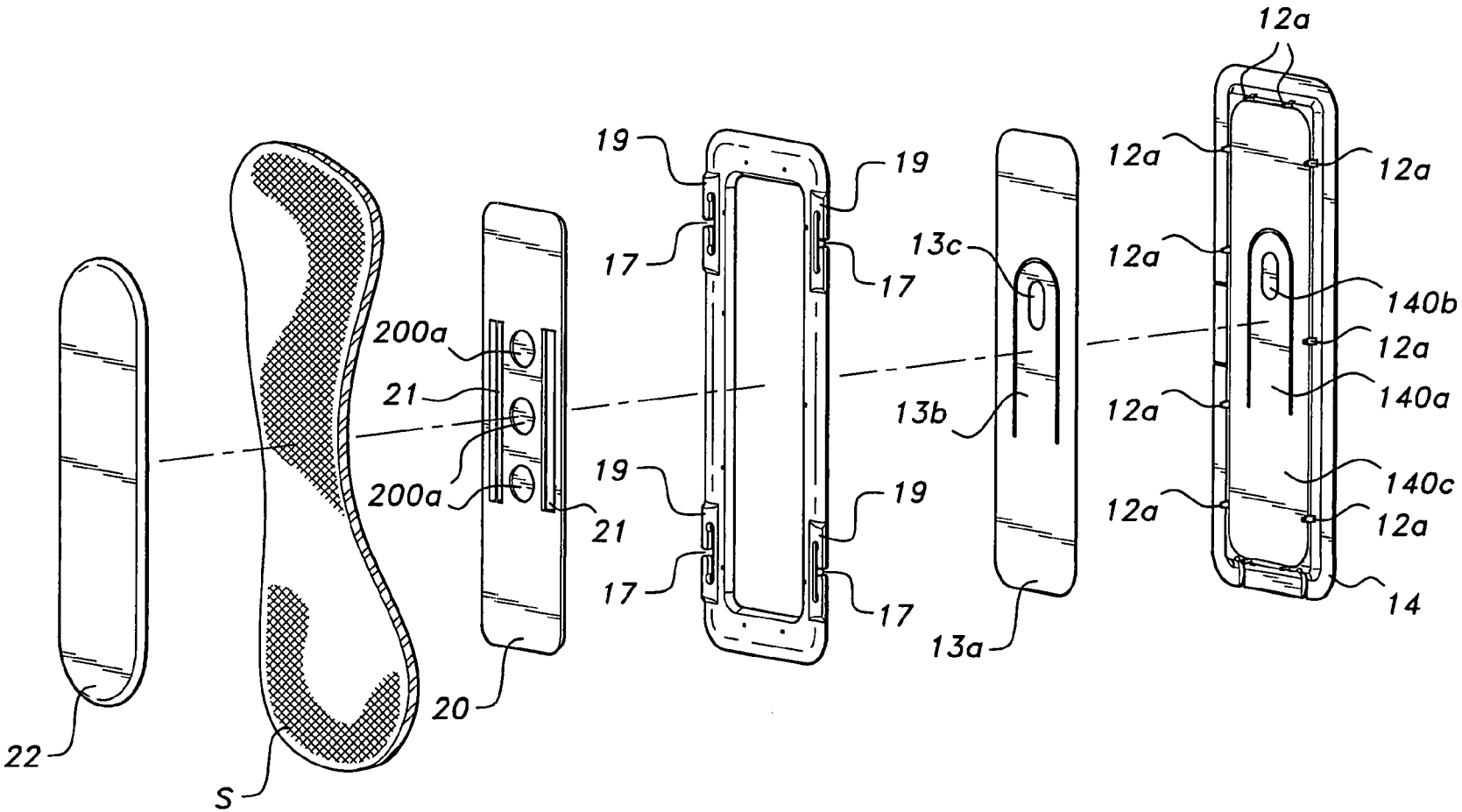
FIG. 2 is an exploded perspective view of a device holder with magnetic retainer according to the present invention as shown from the rear.
Figure 3:
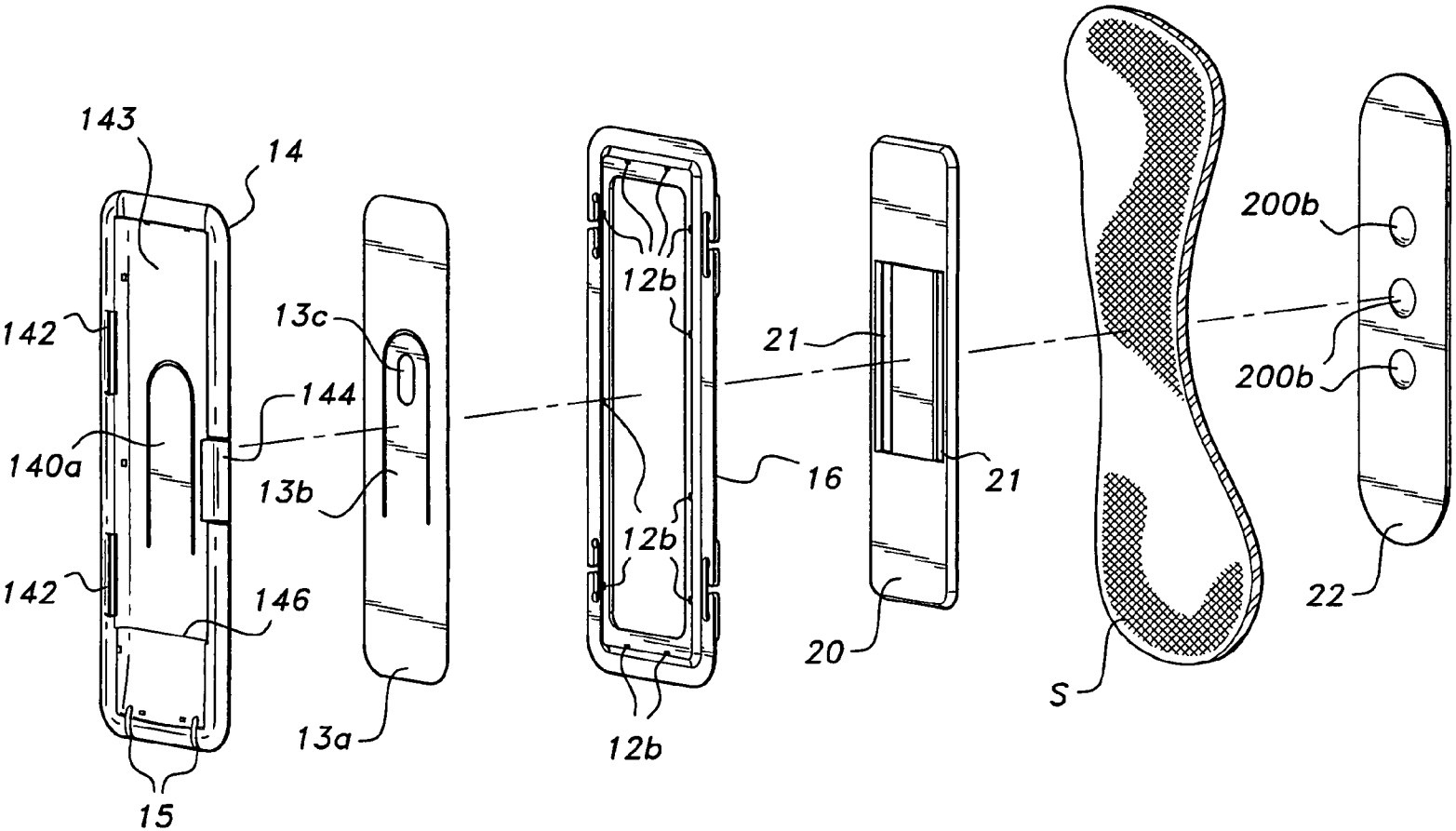
FIG. 3 is a exploded perspective view of a device holder with magnetic retainer, according to the present invention as shown from the front.

The device holder with magnetic retainer, designated generally as 10 in the drawings, is removably attachable to a garment by magnetic attraction. Referring to FIGS. 1A, 2 and 3, the holder 10 typically securely cradles a portable electronic device 11 and includes a device-receiving frame 14, which is a substantially elongate, rectangular member having a recessed area 143 that receives the portable electronic device 11 therein. The portable electronic device 11 may be, without limitation, a cell phone, a PDA, or a portable handheld multimedia device, such as an MP3 player. In the embodiment shown in FIGS. 1A-1B, the portable electronic device 11 is an IPOD® (IPOD is a registered trademark of Apple, Inc. of Cupertino, Calif.) player, which is available in a variety of models. It should be understood that the device-receiving frame 14 may be appropriately dimensioned and configured to accommodate any of a variety of devices, and not just the particular device shown in FIGS. 1A-1B.

Figure 1B:
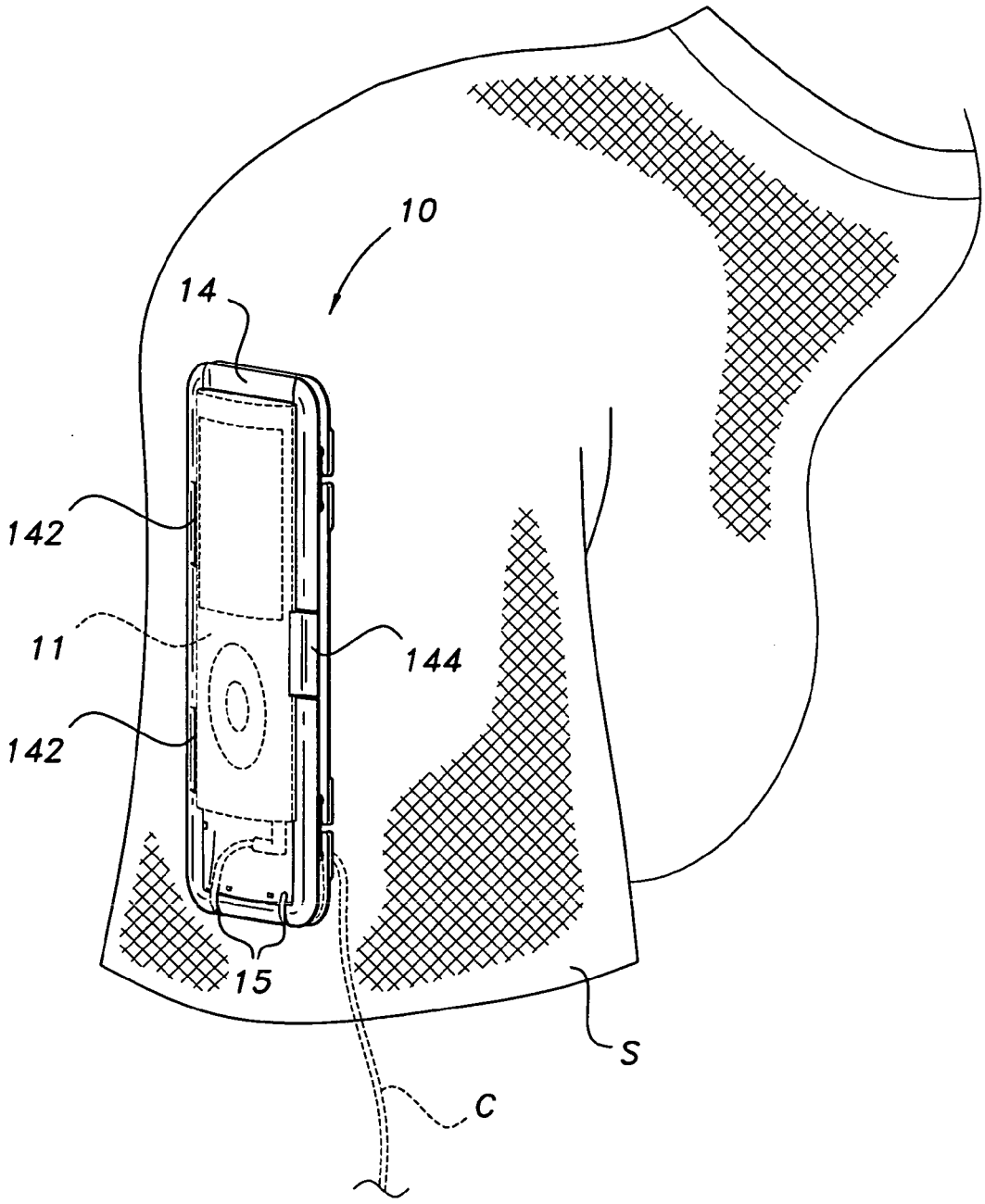
FIG. 1B is an environmental, perspective view of a device holder with magnetic retainer according to the present invention, showing an electronic device having a 90° elbow plug and consequent routing of the headset cord.

As shown in FIGS. 1A-1B a device cord C, e.g., a headset cord, can be routed through any of the cord retention slots 15 disposed on either the bottom or lateral edges of the device-receiving frame 14. A user will pick the slots 15, depending on what type of cord plug his/her device has.

Figure 4:
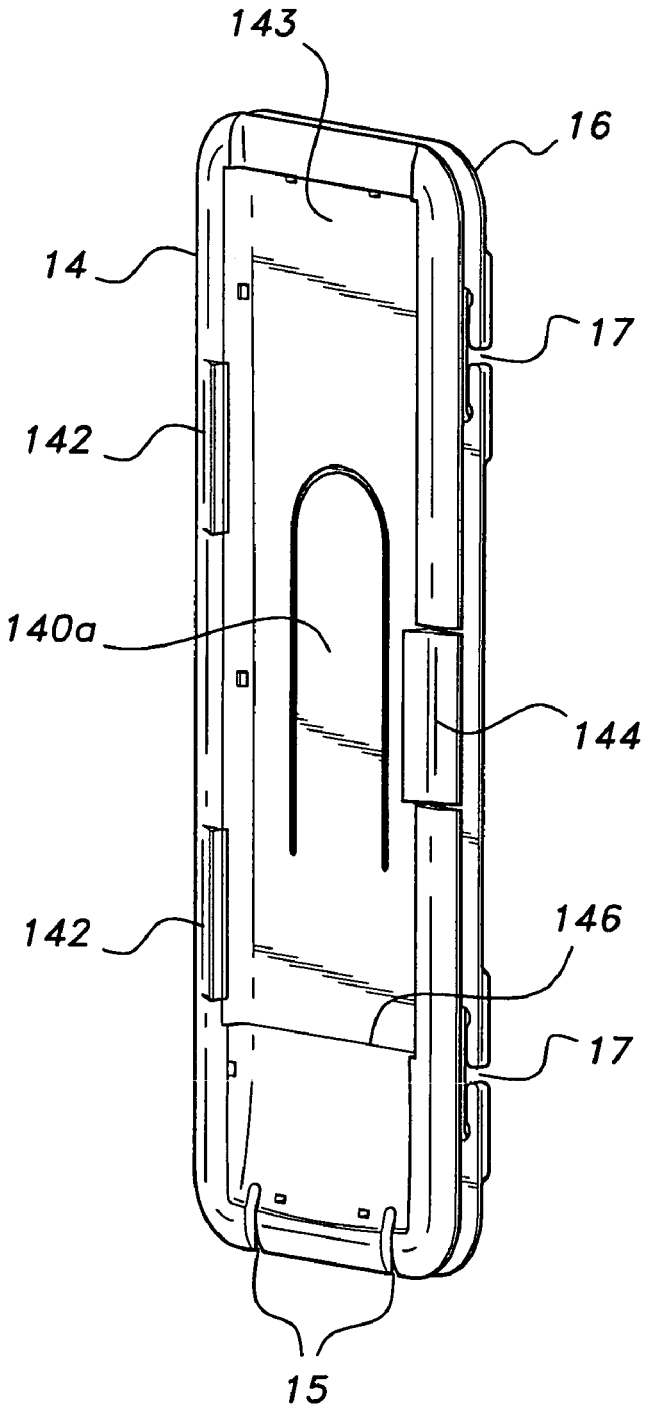
FIG. 4 is a perspective view of a device holder with magnetic retainer, according to the present invention as shown from the front.

Referring to FIGS. 1A and 3, the portable electronic device 11 fits into the recess 143 defined in the front face of the receiving frame 14 and is held in place by device retention tabs 142 and 144. Device retention tab 144 has a living spring hinge, or may simply be a resilient tab that normally extends over the recess, and can be pressed by a user to eject the device 11 from the holder 10. As most clearly shown in FIG. 4, bottom area of the recess 143 may have a raised strip or contour 146 that helps retain the user's electronic device in the receiving frame 14.

As shown in FIGS. 2 and 3, a resilient tongue 140*a* is defined within the recessed area 143 of the receiving frame 14. The tongue 140*a* has a raised guide boss 140*b*. An elongate, planar metal plate 13*a* has a resilient central member or tongue 13*b* partially separated from the plate 13*a* and of substantially identical shape and dimension as the resilient tongue 140 of the receiving frame 14. The metal plate 13*a* fits in rear portion 140*c* of the receiving frame 14. The tongue 13*b* of the metal plate 13*a* has an oval guide slot 13*c* defined therein in alignment with guide boss 140*b* to align the tongues 140*a* and 13*b* when pressing the tongues 1140*a*, 13*b* rearward.

Referring to FIGS. 2 and 3, a hollow elongate backing frame 16 has a plurality of frame attachment slots 12*b* that align with corresponding resilient and hooked retaining tabs 12*a* on back of the device receiving frame 14. When the slots 12*b* are engaged with the retaining tabs 12*a*, the backing frame 16 snaps into contact with the device receiving frame 14 while retaining the planar metal plate 13*a* sandwiched between frame 14 and hollow backing frame 16. The metal plate 13*a* is made of a ferromagnetic material, e.g., a steel plate. A first elongate magnetic member 20 has beveled edges complementary to edges defining the hollow of backing frame 16, thereby allowing the first magnetic member 20 to snugly attach to the backing frame 15 while filling up the hollow. The attachment of first magnetic member 20 to backing frame 15 is facilitated by magnetic attraction between the first magnetic member 20 and planar metal plate 13*a*.

The first magnetic member 20 has laterally opposed elongate apertures 21 which can accommodate a user's webbing strap, or the like for mechanical attachment of the device holder 10 to the user, if desired. The rearward face of the first magnetic member 20 also has a plurality of cylindrical alignment recesses 200*a*. A second magnetic member 22 has rounded protrusions 200*b* that align with alignment recesses 200*a* when the members are magnetically attached to each other. The second magnetic member 22 is designed to be positioned underneath a garment, such as a back of shirt sleeve S, so that a portion of the garment is positioned between the second magnetic member 22, and the first magnetic member 20 for attachment of the device holder 10 to a wearer's garment. The magnets may be embedded in a plastic or other non-magnetic casing. The frame 14 and the backing frame are also preferably made from plastic.

Figure 5:
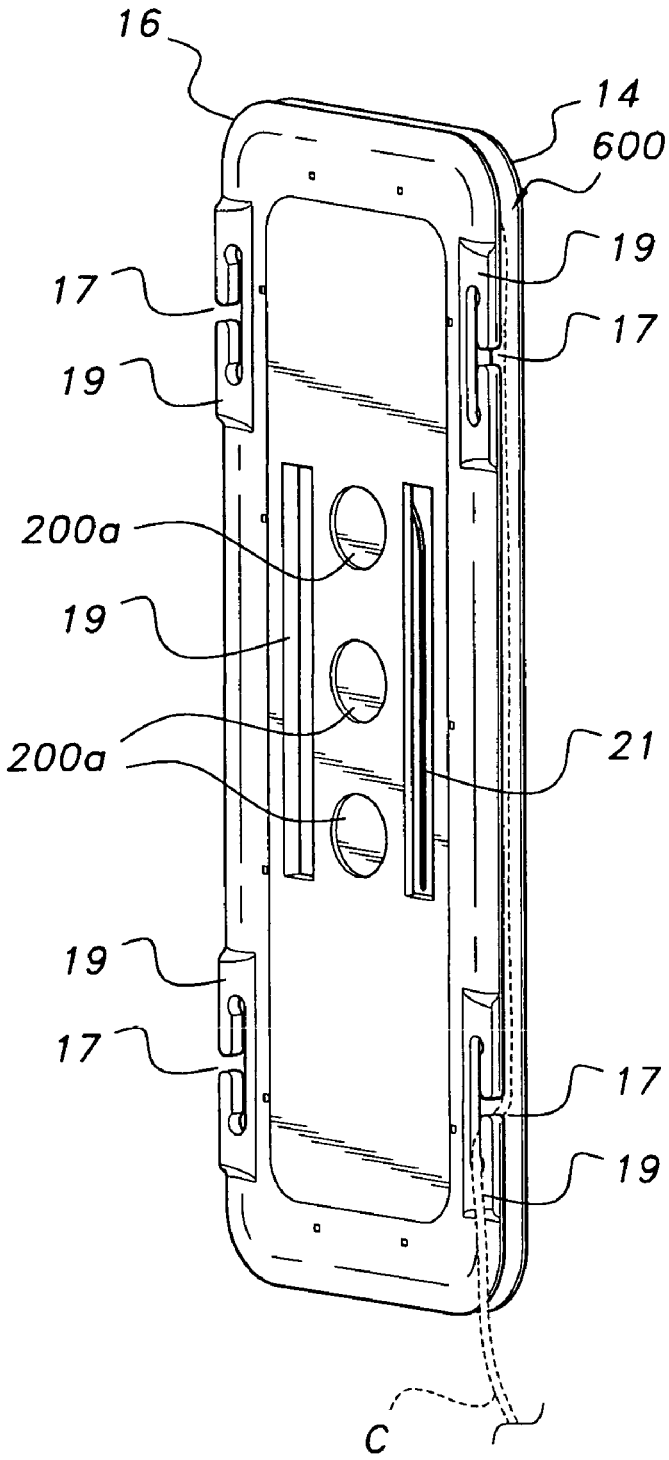
FIG. 5 is a perspective view of a device holder with magnetic retainer according to the present invention as shown from the rear.
Figure 6:
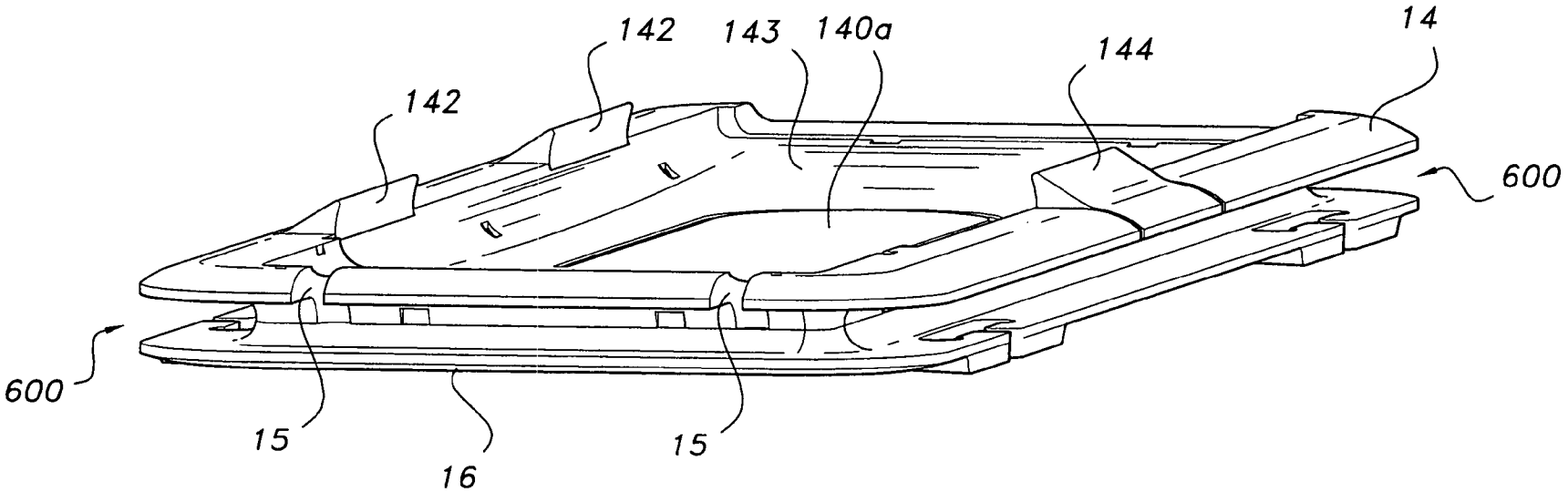
FIG. 6 is a perspective view of a device holder with magnetic retainer according to the present invention as shown from the bottom edge.

Referring again to FIG. 2, cord exit slots 17 are defined by cord guide tabs 19 disposed on opposing longitudinal peripheral edges of the backing frame 16. As most clearly shown in FIG. 6, the attachment of device receiving frame 14 to the backing frame 16 forms a cord channel guide 600 that excess cord of the user's device can be wrapped around. As shown in FIG. 5, the cord can be made to exit the channel via one of the cord exit slots 17.

Figure 7:
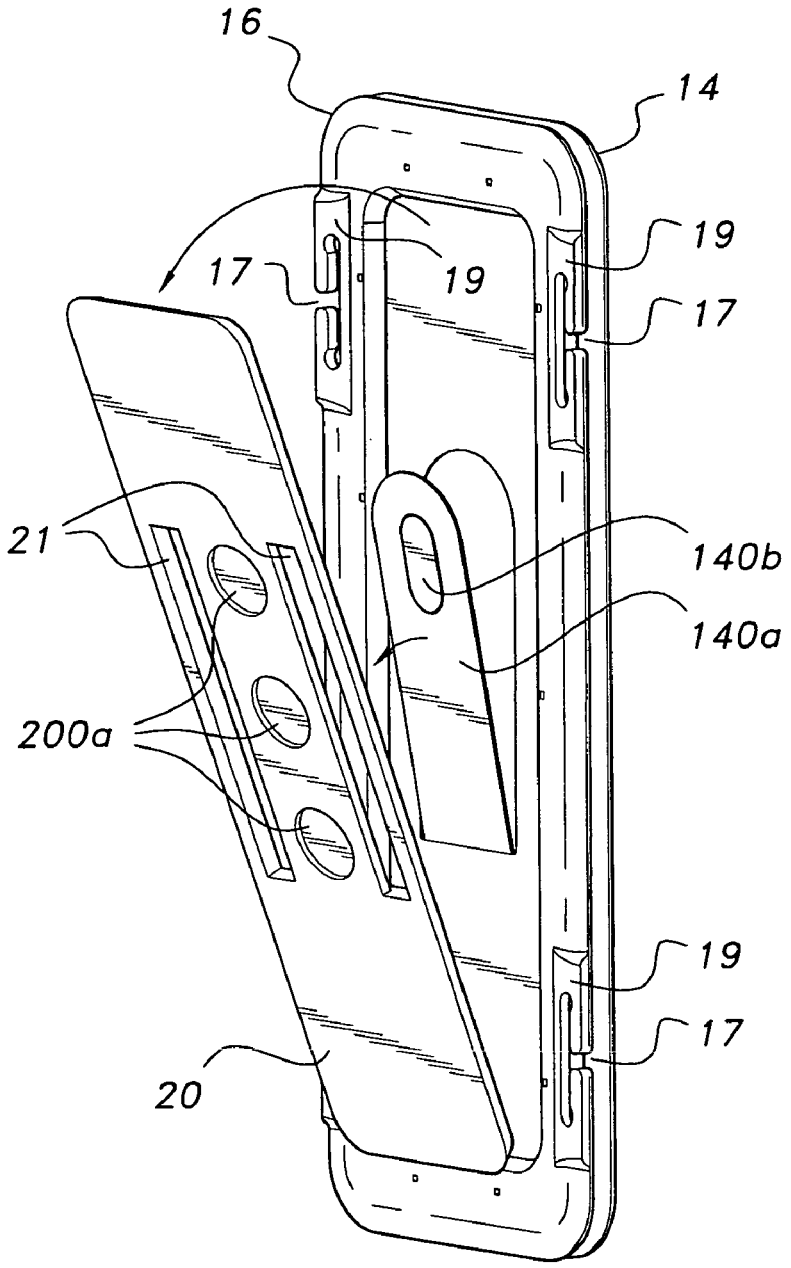
FIG. 7 is a perspective view of a device holder with magnetic retainer according to the present invention, showing the process for removing the first magnetic member from the rear of the frame.

As most clearly shown in FIG. 7, the resilient tongue 140*a* can be used to remove the first elongate magnetic member 20 from the backing frame 16.

It is to be understood that the present invention is not limited to the embodiment described above, but encompasses any and all embodiments within the scope of the following claims.

I claim:

1. A device holder, comprising:

a device-receiving frame having a recess adapted for receiving therein a portable electronic device, the frame having a resilient tongue integrally formed therein, the tongue being bendable in an arc extending rearward;

a planar ferromagnetic metal plate having a resilient tongue integrally formed therein, for engaging the receiving frame tongue;

a first elongate magnetic member;

a hollow elongate backing frame having a rear face defining a recess, the backing frame being attached to a rear portion of the device receiving frame, the ferromagnetic plate being sandwiched between the device receiving frame and the backing frame, the first elongate magnetic member being magnetically attachable to the ferromagnetic plate and seated in the recess when magnetically attached;

a cord receiving channel defined between opposing edges of the device-receiving frame and the backing frame, the channel extending about the periphery of the frames and being adapted for receiving excess cord of the portable electronic device; and a second elongate magnetic member magnetically attachable to the first elongate magnetic member;

whereby the holder is magnetically attachable to a garment when the second magnetic member is placed beneath the garment and the first magnetic member is aligned therewith.

2. The device holder according to claim 1, wherein:

said device-receiving frame has a bottom portion having laterally opposed cord retention slots defined therein for routing a cord of the portable electronic device through and into the cord channel; and said backing frame has a plurality of cord exit slots defined therein for exiting a portion of the cord from the cord channel.

3. The device holder according to claim 2, further comprising first, second and third device retaining tabs disposed on said device-receiving frame to secure the portable electronic device, the third device retaining tab having a living spring hinge.

4. The device holder according to claim 1, wherein said first magnetic member has a plurality of magnets and said second magnetic member has a plurality of magnets.

5. The device holder according to claim 1, wherein said backing frame has retaining slots defined therein and said device-receiving frame has corresponding resilient tabs aligned with the retaining slots to removably and securely attach said device-receiving frame to said backing frame.

6. The device holder according to claim 1, further comprising: a plurality of slots defined in the first magnetic member adapted for accommodating a strap for attaching the device holder to a user.

7. A device holder, comprising:

a device-receiving frame having a recess adapted for receiving therein a portable electronic device the frame having a resilient tongue integrally formed therein, the tongue being bendable in an are extending rearward;

a planar ferromagnetic metal plate having a resilient tongue integrally formed therein, for engaging the receiving frame tongue;

a first elongate magnetic member;

a hollow elongate backing frame having a rear face defining a recess, the backing frame being attached to a rear portion of the device receiving frame, the ferromagnetic plate being securely held between the device receiving frame and the backing frame, the first elongate magnetic member being magnetically attachable to the ferromagnetic plate and seated in the recess when magnetically attached; and a second elongate magnetic member magnetically attachable to the first elongate magnetic member;

whereby the holder is magnetically attachable to a garment when the second magnetic member is placed beneath the garment and the first magnetic member is aligned therewith.

8. The device holder according to claim 7, wherein:

said device-receiving frame has a bottom portion having laterally opposed cord retention slots defined therein for routing a cord of the portable electronic device through and into the cord channel; and said backing frame has a plurality of cord exit slots defined therein for exiting a portion of the cord from the cord channel.

9. The device holder according to claim 8, further comprising first, second and third device retaining tabs disposed on said device-receiving frame to secure the portable electronic device, the third device retaining tab having a living spring hinge.

10. The device holder according to claim 7, wherein said first magnetic member has a plurality of magnets and said second magnetic member has a plurality of magnets.

11. The device holder according to claim 7, wherein said backing frame has retaining slots defined therein and said device-receiving frame has corresponding resilient tabs aligned with the retaining slots to removably and securely attach said device-receiving frame to said backing frame.

12. The device holder according to claim 7, further comprising: a plurality of slots defined in the first magnetic member adapted for accommodating a strap for attaching the device holder to a user.

* * * * *